US007324066B2

(12) United States Patent
Hirtt

(10) Patent No.: US 7,324,066 B2
(45) Date of Patent: Jan. 29, 2008

(54) ANTENNA REFLECTOR

(75) Inventor: Pierre Hirtt, Luxembourg (LU)

(73) Assignee: Hitec Luxembourg S.A., rue de l'eglise (LU)

( * ) Notice: Subject to any disclaimer, the term of this patent is extended or adjusted under 35 U.S.C. 154(b) by 0 days.

(21) Appl. No.: 10/566,361

(22) PCT Filed: Jul. 27, 2004

(86) PCT No.: PCT/EP2004/051623

§ 371 (c)(1),
(2), (4) Date: Jan. 30, 2006

(87) PCT Pub. No.: WO2005/013421

PCT Pub. Date: Feb. 10, 2005

(65) Prior Publication Data

US 2006/0238438 A1 Oct. 26, 2006

(30) Foreign Application Priority Data

Jul. 29, 2003 (LU) ..... 91033

(51) Int. Cl.
*H01Q 15/14* (2006.01)

(52) U.S. Cl. ..... 343/912

(58) Field of Classification Search ..... 343/912, 343/915, 840
See application file for complete search history.

(56) References Cited

U.S. PATENT DOCUMENTS

| | | | | |
|---|---|---|---|---|
| 4,693,629 | A | 9/1987 | Bruinsma | |
| 4,860,023 | A * | 8/1989 | Halm | 343/912 |
| 4,972,197 | A * | 11/1990 | McCauley et al. | 343/704 |
| 5,686,930 | A * | 11/1997 | Brydon | 343/912 |
| 5,920,289 | A | 7/1999 | Jones | |
| 2003/0082315 | A1 * | 5/2003 | Mehlman et al. | 428/16 |

FOREIGN PATENT DOCUMENTS

| | | |
|---|---|---|
| EP | 0 7841 435 A1 | 11/1996 |
| GB | 2 215 523 A | 9/1989 |

* cited by examiner

*Primary Examiner*—Hoang V. Nguyen
(74) *Attorney, Agent, or Firm*—Bacon & Thomas, PLLC

(57) ABSTRACT

An antenna reflector panel comprises a reinforcing element and a reflector sheet being mounted onto said reinforcing element. The reinforcing element comprises a block of a machinable material having a shaped front surface, the reflector sheet being fixed to the front surface of the block so as to form a first skin layer of the block of machinable material.

6 Claims, 3 Drawing Sheets

ANTENNA REFLECTOR

This application is a 371 of PCT/EP04/51623 dated 27 Jul. 2004.

FIELD OF THE INVENTION

The present invention relates to an antenna reflector especially for parabolic and shaped antennas for radio frequency emission and reception. Typically such antennas are used e.g. for communication to and from satellites (ground segment of satellite communication), point to point communication (terrestrial communication), etc.

BACKGROUND OF THE INVENTION

Antenna reflectors for parabolic and shaped antennas may be formed of a single piece or can be split in several reflector segments (panels) that are assembled together in order to form one closed antenna dish. The antenna's or antenna panel's inner surface is typically made of a sheet material suitable to reflect the electromagnetic waves. The required surface accuracy depends on the signal wavelength and on the application that the antenna is used for (e.g. communication only, telemetry and tracking of satellites, etc.). Surface errors do determine the quality of the emission/reception pattern, which at the end is the required criterion. Antenna pattern quality must meet specified requirements for the main lob (amplitude and width) and of the side lobs (amplitude below specified level).

Such surface errors can be systematic or random. The errors do affect the quality of the pattern either by the width of the main lob or by causing excessive amplitude of one or more side lobs. Systematic errors are generally related to the condition/quality of the manufacturing tools or to the antenna/panel design. Random errors are generally related to the manufacturing process.

(Systematic errors can be reduced to a desired level with appropriate efforts, e.g. by adjusting or improving the shape giving tools.)

The classic design of antennas/panels is based on a metal sheet (mostly aluminum), which is shaped into the required shape and then reinforced from the backside with a backing structure. The backing structure is typically made of profiles and bonded to the sheet by adhesive or by mechanical fasteners.

However, this design is cause of three different kinds of errors that can only be reasonably reduced but not be removed.

1. After the assembly process of the reflective sheet with the reinforcing structure, the shape can change because of (systematic and variable) strain that is induced in the sheet and/or the reinforcing structure during the assembly process. The thicker the sheet, the more difficult to control the remaining strain.
2. The reflective sheet is only supported on the reinforcing structure. Consequently the strain in the sheet will cause deviation of sheet surface from the theoretical shape as "waves" from one reinforcing profile to the next. Typically the reinforcing profiles are spaced several 10 cm for a reflector panel of size 1 to 2 meters. This will cause a source of periodic inaccuracy in the antenna surface in the same pitch.
3. The thickness of the reflective sheet is determined by mechanical criteria to give the sheet/structure assembly a desired rigidity. Many antenna/panel designs comprise a lining sheet made of several stripes in order to be able to process the sheet to the required shape. The thicker the sheet, the smaller the stripes should be. Such stripes again do deviate from the theoretical shape such that waves appear from the center of the stripes to the edges. Accordingly this behavior constitutes a second source of periodic inaccuracy in the antenna surface.

Whereas the randomly distributed surface inaccuracies affect mainly the shape of the main lob, periodic surface error may create extreme and unexpected effects in the side lobs of the antenna pattern.

U.S. Pat. No. 5,920,289 discloses a satellite antenna reflector panel, which comprises a reflector sheet and a reinforcing element. The reinforcing element comprises a honeycomb core with a front skin layer and a back skin layer, each made of a fiberglass cloth. A heater assembly comprising a resistance heaterwire sandwiched between two layers of fiberglass cloth is arranged on top of skin layer. The reflector sheet is arranged on top of the heater assembly and covered by a further fiberglass cloth and a front surface made of plastic material.

An ultra lightweight membrane reflector antenna for use in outer space is disclosed in document EP 0 741 435 A. This antenna comprises a reflector membrane, which is mounted on a reinforcing element. The reflector membrane itself comprises a thin shapeable honeycomb core with two single ply membrane outer layers, which are laminated onto the reinforcing core after the latter has been formed into the required shape. This reflector membrane is mounted onto a rear reinforcing element, which comprises an outer peripheral reflector ring and a rear support frame portion.

SUMMARY OF THE INVENTION

The object of the present invention is to provide an antenna reflector, which reduces the above mentioned errors.

This object is achieved by an antenna reflector panel according to claim 1. This antenna reflector panel comprises a reinforcing element and a reflector sheet being mounted onto said reinforcing element. According to the invention, the reinforcing element comprises a block of a machinable material having a shaped front surface, said reflector sheet being fixed to said front surface of said block so as to form a first skin layer of said block of machinable material.

In contrast to the known antenna panel designs, the present invention proposes to use a block of a machinable material having a suitably shaped front surface as a reinforcing structure. Such a material having a machined front surface provides a continuous or quasi-continuous backing surface for the reflective sheet. It follows that the reflective sheet is supported on its entire surface by the reinforcing structure, thus reducing possible causes for reflector deformations. In other words, in order to overcome the above mentioned problems, the present invention uses a reinforcing structure that enables a fixing of the reflective sheet on its entire surface onto the reinforcing structure. The term "entire surface" has to be understood as relative to the required surface accuracy and the thickness of the sheet in such a way that any remaining gap between bonding points shall not cause the reflective sheet to deviate significantly and in a periodic manner from its theoretical shape.

The possibility to reduce such systematic and random errors and the possibility to remove such periodic errors will result in an antenna with normally distributed surface inaccuracies and as such will drastically improve the antenna pattern compared to a classic antenna with the same overall surface accuracy. Consequently, the tolerated surface accuracy can be increased in order to achieve the same antenna performance (pattern quality).

It will be noted that the fact of "entire surface" bonding will allow to use considerably thinner reflective sheet to meet the required mechanical criteria while not effecting the electrical reflection. The reduced thickness of the reflective sheet leads of course to a reduced weight of the reflector sheet and to reduced manufacturing costs.

The material of the reinforcing structure shall be light weight and shall create for the same weight a structure of equal or superior rigidity than traditionally used reinforcing structures. Appropriate material for the reinforcing structure shall have a non full structure e.g. porous or otherwise build structure with significant free space inside. A known material today to meet the above requirements is honeycomb core, which is widely used for making light weight sandwich panels in a multitude of applications. Similar sandwich panels are also made with various qualities of foam as inner material and it must be taken into account that one such material may also be suitable.

It will be noted that the use of honeycomb (or other material of similar mechanical characteristics) as material for the reinforcing structure considerably improves the surface accuracy of the antenna reflector and accordingly solves the problem of the mentioned random and periodic surface accuracy errors while not creating other negative or undesired design or application effects. Furthermore its use allows some significant advantages over classic design antennas especially but not limited to the application field of satellite ground segment antennas and here again especially in the frequency range of approximately 10 GHz and up where surface accuracy is difficult to achieve for reasonable cost.

In particular, this document describes the use of honeycomb core as reinforcement for the antenna/panel, a technology that has several significant advantages over standard design of antennas so far. The various advantages will be described individually.

As such, the honeycomb reinforcement can replace either only the reinforcement of the individual reflector panels, which then are installed in a classic approach onto a reflector backup structure. Depending on size and application, the reinforcement may become the entire supporting structure and thus also replace the classic reflector backup structure.

BRIEF DESCRIPTION OF THE DRAWINGS

The present invention will be more apparent from the following description of several not limiting embodiments with reference to the attached drawings, wherein.

DETAILED DESCRIPTION

Figure 1:
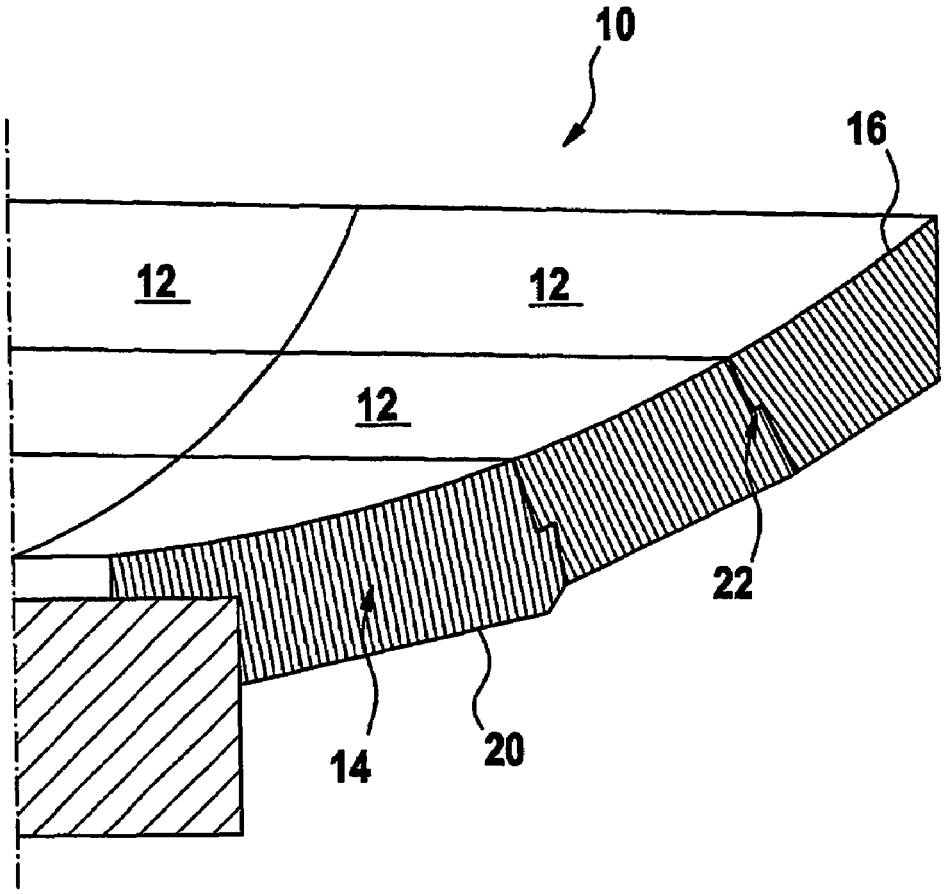
FIG. 1: is a schematic view of a section of an antenna reflector comprising several reflector panels or segments.
Figure 2:
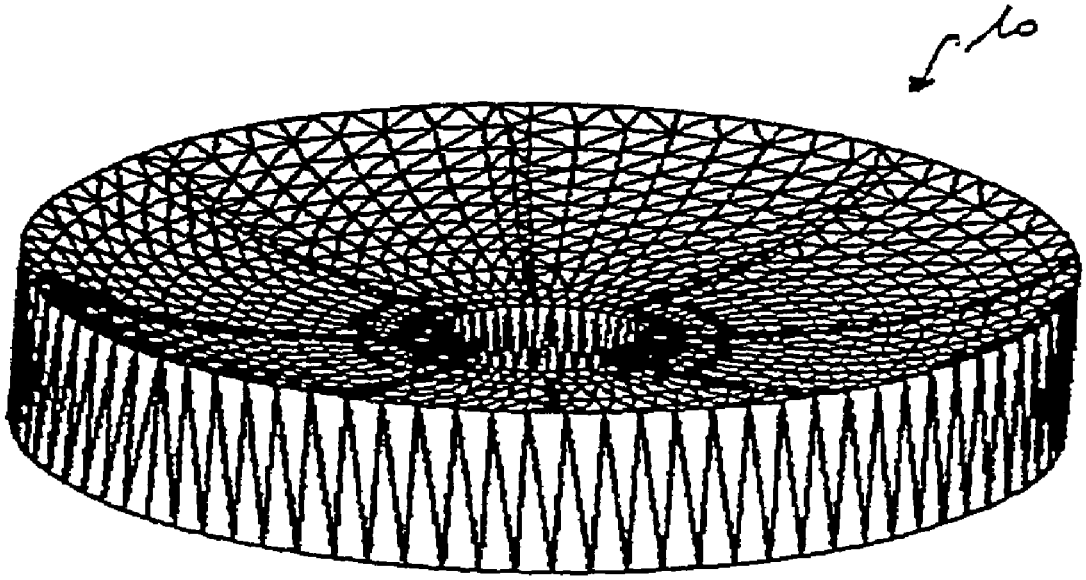
FIG. 2: is a perspective view of an antenna reflector.
Figure 3:
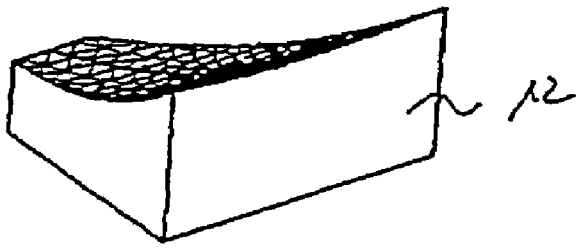
FIG. 3: an antenna reflector panel.

FIG. 1 shows a section of an antenna reflector 10 comprising several reflector sections or panels 12. The different panels 12 of the antenna are suitably shaped so as to form one closed antenna dish when assembled together. A 3d view of an antenna dish 10 is shown in FIG. 2, whereas FIG. 3 shows the shape of single panel 12.

A honeycomb block 14 of appropriate size is prepared and machined to the required concave 3-d shape of the reflector or reflector segment 12.

Figure 4:
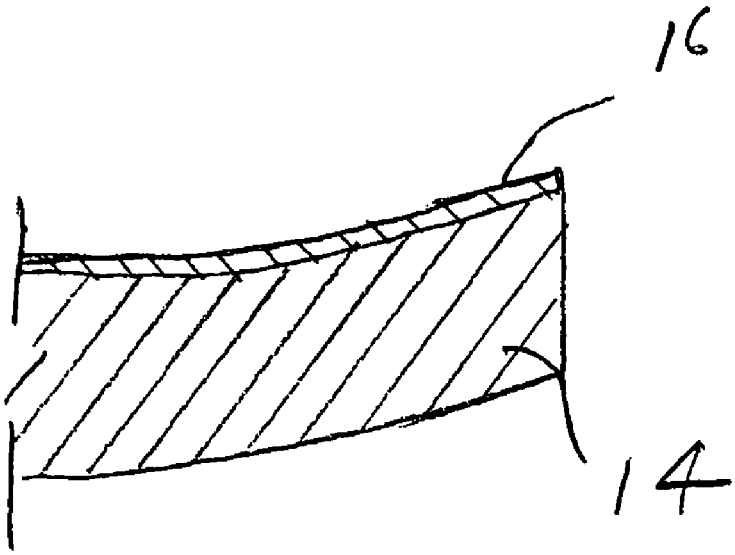
FIG. 4: is a partial cross-sectional view illustrating the reflector sheet.
Figure 5:
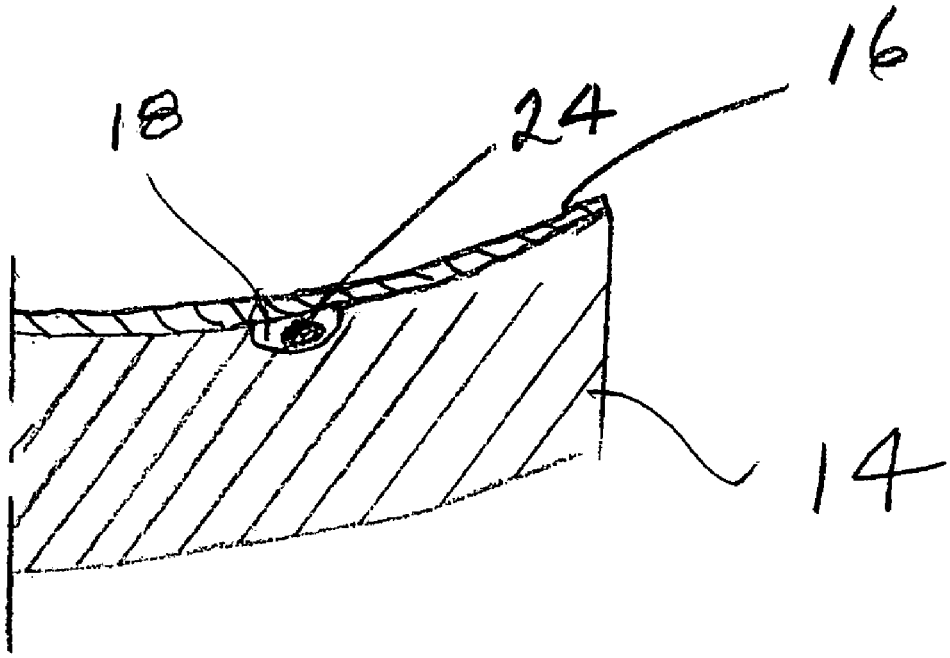
FIG. 5: is a partial cross-sectional view illustrating the groove and heating element arrangement.

The reflective sheet 16 (metal or carbon fiber material) is then directly adhered to the concave inside of the so machined block (FIGS. 4 and 5). The adhesion process is standard practice as known in processing honeycomb products and of other-wise flat or shaped sheet, which is reinforced with appropriate (metal) profiles by adhesion process. As one example it is mentioned that these adhesion processes are used since many years and are well under control for aeronautical products like aircraft interior panels or elements of wings etc.

Honeycomb core as such has no lateral rigidity. It is only an adhered skin, perpendicular to the honeycomb canals, on each outside and possibly addition intermediate layers that enable a honeycomb structure to take bending stress. In the antenna reflector application, the reflective sheet of the antenna itself acts at the same time as the electrical reflector sheet for the radio waves and as an integral part of the reinforcing structure by taking the role of one of the skin sheets.

The honeycomb block is prepared before machining by applying the back skin 20. As required, the honeycomb block can be further reinforced with intermediate sheets to take possible strain. The honeycomb block is then made of two or more layers of honeycomb core, which are separated with additional sheets like the back skin.

The core material, the product form (like hexagonal cell or rectangular cell) as well as other honeycomb core parameters like cell size, density or manufacturing tolerances are depending on the requirements of each specific case and are function of various parameters like, but not limited to the following examples: antenna size, electrical data like radio frequency wavelength, external influence like wind and weather conditions, applications like satellite TT&C, etc.

The fact that honeycomb core has a relatively small cell size (3 to 10 mm) allows that the reflective sheet can be considerably thinner than reflector panels that are made of reflector sheet with reinforcement by Z-profiles (riveted or adhered). Classic reflector panels are made of aluminum of 1.5 mm thickness or more. Honeycomb panels do have superior strength already with skin sheet of 0.5 mm or less. This reduces weight and it becomes much more easy to shape the reflective sheet. Consequently the remaining strain (tensions in the sheet) is lower. This in return assures a better shape stability after assembly (adhesion) of the sheet to the honeycomb core.

As a further advantage, the strain in the sheet with the reflector under load (gravity, wind, etc.) is well distributed over the entire skin surface, compared to panels that are reinforced with Z-profiles with a much larger pitch. This allows for a larger choice for the material of the reflective sheet. Typically the reflector sheet is made of aluminum as a compromise of weight/price/mechanical data. A main disadvantage of standard aluminum is its relatively high thermal dilation, which is a serious constrain for precision antennas (solar radiation heat up). The lower strain (mechanical load) and the possibility for thinner sheet (less material) allows to choose material with lower thermal dilation factors. Depending on the application, the same reason also allows to choose material of more optimized electrical behavior in terms of reflecting radio waves.

Various ways to combine the reflective sheet with the concave honeycomb block are possible.

For high precision requirements, the reflective sheet is shaped on appropriate templates (negative). This part of the process is still comparable to known standard procedures for traditional panels. The sheets can be hold to the template by vacuum or can be pulled and hold on the edges in order to fit perfectly on the template. The shaped concave honeycomb block is then adhered to the sheet. The combined "honeycomb block and sheet" structure dos not significantly change shape after it is released from the template. Thus the quality of the template determines the quality of the shape. But the fact of lower strain in the sheet improves the quality of the panel after removal from the template compared to traditionally build panels.

If less surface accuracy is required, the reflective sheet segments can be preshaped in a press or by other means. This part of the process is also comparable to standard procedures for press-formed dishes. Only now the sheet can be thinner because it will get the required rigidity when this pre-formed sheet is adhered to the honeycomb block.

Standard processing of the honeycomb core allows to insert concrete material (cement) in order to create strong and rigid fixation points. This can be used to create precise connection points 22 between antenna segments. These enable that the segments can be assembled as self-supporting structure (without backup structure) and allow them to be disassembled and reassembled with sufficient precision so that after re-assembling, the required overall accuracy of the reflector shape is again assured. Thus, time intensive and consequently expensive on-site alignment work becomes obsolete. Such required precise interface points can be integrated on the template and integrated into the panels at the time of manufacturing, i.e. during adhesion of the honeycomb block onto the reflector sheet. The second application is to create during fabrication also the spots for flanging the sub-reflector multipod directly to the outer surface of the antenna reflector.

Some antennas must operate free of snow and ice and are therefore equipped with a de-icing system (FIG. 5). These systems are either made of surface heating elements that are assembled to the backside of the reflector sheet or behind the reflector panels is a free closed area with circulating hot air. In both cases the reflector panel sheet is heated directly because it is directly accessible. Honey-comb core is an excellent isolator and these approaches would isolate the back side of the reflector sheet and such de-icing would not work. The heating element(s) 24 can be situated in groove(s) 18 in the block 14.

Because of the relatively small cell size and because honeycomb core can be machined, it is possible to prepare the concave side of the block with groves to mount standard heating elements. This can be electrical or fluid based heating tubes. Both types are available as standard, long life proven and cost effective components for use in floor heating systems or similar. The honeycomb core is a perfect thermal insulation so that the heating system has no loss of heat to the back of the reflector.

The present invention provides for an improved antenna reflector or reflector panel, the benefits of which can be summarized as follows:

weight—less than traditional construction for the same requirements price—fabrication is faster, handling easier, on-site installation faster, much simplified reflector construction de-icing—integrated standard products, integrated into panel at factory reflector material—either more cost effective, or optimal electrical behavior, or optimal thermal behavior

The invention claimed is:

1. An RF ground antenna comprising:

at least one antenna reflector panel; and a metal reflective sheet mounted on said at least one antenna reflector panel, wherein:

said at least one antenna reflector panel formed as a reinforcing element comprising a block of machinable material;

said block of a machinable material having a machined front surface for receiving said metal reflective sheet; and said metal reflective sheet being fixed directly to said machined front surface of said block of machinable material so as to form a first skin layer of said block of machinable material.

2. The RF ground antenna of claim 1, wherein:

said metal reflective sheet is adhered on said at least one antenna reflector panel.

3. The RF ground antenna of claim 1, further comprising:

a second skin layer mounted on a rear surface of said block of machinable material.

4. The RF ground antenna of claim 1, wherein:

said block of machinable material is comprised of a honeycomb core.

5. An RF ground antenna comprising:

at least one antenna reflector panel; and a metal reflective sheet mounted on said at least one antenna reflector panel, wherein:

said at least one antenna reflector panel formed as a reinforcing element comprising a block of machinable material;

said block of a machinable material having a machined front surface for receiving said metal reflective sheet;

said metal reflective sheet being fixed directly to said machined front surface of said block of machinable material so as to form a first skin layer of said block of machinable material; and a plurality of antenna reflector panels are provided with index means provided for interlocking the panels together.

6. An RF ground antenna comprising:

at least one antenna reflector panel;

a metal reflective sheet mounted on said at least one antenna reflector panel; and a heating element arranged in at leaste one groove formed in said block of machinable material, wherein:

said at least one antenna reflector panel formed as a reinforcing element comprising a block of machinable material;

said block of a machinable material having a machined front surface for receiving said metal reflective sheet; and said metal reflective sheet being fixed directly to said machined front surface of said block of machinable material so as to form a first skin layer of said block of machinable material.

* * * * *